US007242390B2

(12) United States Patent
Bader et al.

(10) Patent No.: US 7,242,390 B2
(45) Date of Patent: Jul. 10, 2007

(54) ELECTRIC SWITCH

(75) Inventors: Michael Bader, Aldingen (DE); Markus Kramer, Spaichingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 11/347,767

(22) Filed: Feb. 3, 2006

(65) Prior Publication Data

US 2006/0124438 A1 Jun. 15, 2006

Related U.S. Application Data

(63) Continuation of application No. PCT/EP04/008835, filed on Aug. 6, 2004.

(30) Foreign Application Priority Data

Aug. 8, 2003 (DE) ..... 103 36 507

(51) Int. Cl.
*G09G 5/08* (2006.01)

(52) U.S. Cl. ..... 345/161; 345/156; 345/157; 345/184; 463/38

(58) Field of Classification Search ..... 345/156, 345/157, 161, 184
See application file for complete search history.

(56) References Cited

U.S. PATENT DOCUMENTS

| | | | | |
|---|---|---|---|---|
| 4,670,743 | A | 6/1987 | Zemke | |
| 4,947,097 | A | 8/1990 | Tao | |
| 5,125,602 | A | 6/1992 | Vauvelle | |
| 5,805,140 | A * | 9/1998 | Rosenberg et al. | 345/161 |
| 5,944,151 | A | 8/1999 | Jakobs et al. | |
| 6,630,635 | B1 * | 10/2003 | Doepner | 200/6 A |
| 6,894,234 | B1 | 5/2005 | Sottong | |
| 7,061,466 | B1 * | 6/2006 | Moore et al. | 345/156 |
| 2002/0163498 | A1 | 11/2002 | Chang et al. | |

FOREIGN PATENT DOCUMENTS

| | | |
|---|---|---|
| DE | 40 18 686 A1 | 12/1990 |
| DE | 690 00 583 T2 | 2/1992 |
| DE | 296 04 717 U1 | 5/1996 |
| DE | 195 28 457 A1 | 2/1997 |
| DE | 197 12 048 C2 | 9/1998 |
| DE | 199 07 620 A1 | 8/2000 |
| DE | 199 22 638 A1 | 11/2000 |
| DE | 199 46 021 A1 | 11/2000 |
| DE | 200 14 425 U1 | 1/2001 |
| DE | 100 21 895 A1 | 2/2001 |
| DE | 202 19 655 U1 | 3/2003 |
| EP | 0 628 976 A1 | 12/1994 |
| GB | 2 350 170 A1 | 11/2000 |
| WO | 00/39783 A1 | 7/2000 |
| WO | 03/023802 A1 | 3/2003 |

* cited by examiner

*Primary Examiner*—Richard Hjerpe
*Assistant Examiner*—Jennifer T. Nguyen
(74) *Attorney, Agent, or Firm*—Burr & Brown

(57) ABSTRACT

An electrical switch having a form of one of a joystick and a cursor switch is provided, including an operating element. The operating element interacts with at least one of rotation means such that the operating element can be rotated, and with movement means such that the operating element can be moved in at least one linear direction on a movement plane. The operating element has a switching effect on a switching element during rotation and/or during movement.

19 Claims, 7 Drawing Sheets

ELECTRIC SWITCH

CROSS REFERENCE TO RELATED APPLICATIONS

This application is a continuation of International Application No. PCT/EP2004/008835 having an international filing date of Aug. 6, 2004, which designated the United States, and claims the benefit under 35 USC §119(a)–(d) of German Application No. 103 36 507.9 filed Aug. 8, 2003, the entireties of which are incorporated herein by reference.

FIELD OF THE INVENTION

The present invention relates to an electrical switch.

BACKGROUND OF THE INVENTION

Electrical switches which are in the form of a joystick switch or cursor switch are used by a user to enter data for an electrical appliance. By way of example, switches such as these are used for car radios, navigation appliances, on-board computers or else for controlling other functions in motor vehicles, in which case, by way of example, the switch may be arranged on the motor vehicle steering wheel. In particular, an electrical switch such as this can also be used as a multifunction switch for menu control of functions via a display in the motor vehicle.

One such electrical switch is known from DE 296 04 717 U1. This switch has an operating element which can be pivoted and can be moved, such that the operating element can be moved into two mutually perpendicular directions. The operating element is designed such that it can be rotated further. Finally, the operating element can also be operated by pushing it.

DE 296 04 717 U1 does not include any further details relating to the design of the means for pivoting or linear movement, as well as for rotation. In particular, it contains no information as to how the functionality of rotation and movement can be provided by means of a single operating element. Finally, it is also not possible to determine whether this switch is suitable for use in a motor vehicle where the installation areas are confined.

SUMMARY OF THE INVENTION

The invention is based on the object of providing a means which allows the rotation and/or movement of the single operating element. In particular, the operating element is intended to have a tactile sense which can be sensed by the user and may be variable. In particular, this means is also intended to be designed in such a way that the switch, which is provided with a high degree of functionality, occupies little physical space.

In the case of an electrical switch of this generic type, this object is achieved by the features according to the first, second and third embodiments of the present invention as described below.

The electrical switch according to the present invention provides a rotary, push-button and slide controller which offers a variable tactile sense for rotation and sliding, depending on the selected function. A switch such as this can advantageously be used as an input means for the (MMI) man-machine interface of the controller.

In a first embodiment of the electrical switch according to the invention, the operating element interacts with rotation means in such a way that the operating element can be rotated and in the process has a switching effect on a switching element. A controllable external rotor electric motor is operatively connected to the operating element, with at least a part of the rotation means comprising the external rotor of the external rotor motor. The external rotor motor allows a variable tactile sense to be produced for the rotary movement of the operating element.

In a second embodiment of the electrical switch according to the invention, the operating element interacts with movement means in such a way that the operating element can be moved in at least one direction on a movement plane, and in the process has a switching effect on a switching element. A magnet is operatively connected to the operating element. The magnet is used to produce a tactile sense for the linear movement of the operating element.

In a third embodiment of the electrical switch according to the invention, the operating element on the one hand interacts with rotation means in such a way that the operating element can be rotated, while on the other hand the operating element interacts with movement means in such a way that the operating element can be moved in at least one direction on a movement plane. In this case, the operating element has a switching effect on a switching element during rotation and during movement. A cross carriage is used to transmit the linear movement as well as the rotary movement from the operating element to the movement and rotation means, with the rotation axis of the rotation means being approximately at right angles to the movement plane of the movement means.

Further refinements of the invention are the subject matter of the dependent claims.

In order to provide a type of "Enter" function as confirmation of an input, the operating element can be moved linearly through at least one distance from a null position to a switch position by pushing, to be precise preferably at approximately right angles to the movement plane. In this case, the operating element has a switching effect on a switching element in the switch position, as a result of which the switching signal which is produced by the switching element can be evaluated as an input confirmation. A low-cost version of the switching element may comprise a switching mat.

The operative connection between the magnet and the operating element can be produced in a compact form by means of a ball lever. The ball lever has a ball in the form of a ball joint as a pivoting bearing. The desired, variable increase in force is produced by the length ratio of the two lever arms which originate from the ball. The ball lever has an end which is attached to the operating element on one lever arm, and has a free end on the other lever arm. A permanent magnet is attached to the free end, and interacts with the magnet. If the magnet is in the form of a controllable adhesion electromagnet, then the tactile sense can be varied as desired by controlling it appropriately.

The small physical size of the electrical switch is further assisted by arranging the stator of the external rotor on a stationary, internal hollow shaft. The external rotor is mounted such that it can rotate by means of journal bearings on the hollow shaft and/or by means of a ball raceway on a supporting part, which is attached to the hollow shaft, in the external rotor motor. The ball holder for the ball joint of the ball lever is arranged on the internal hollow shaft in the external rotor motor. Finally, the magnet is located in the internal hollow shaft in the external rotor motor.

For applications in motor vehicles, it is particularly suitable for the switching elements which detect the rotation and/or the movement and/or the pushing to be Hall sensors, magnetoresistive sensors, electrical switches, switching mats or the like. These are not susceptible to faults and are highly reliable in operation.

Production of the tactile sense by means of the external rotor electric motor offers the advantage that the windings for the stator are located internally, and the permanent magnets are guided externally on the rotor side. The mechanism for the sliding movement is guided on the rotor and in the internal motor shaft, which is in the form of a hollow shaft. This decouples the masses for the sliding movement and the rotary movement. A permanent magnet which has a coil and produces an active sliding tactile sense as a function of movement is arranged for the sliding movement.

The advantages achieved by the invention are, in particular, that the switch has only a small physical size despite a high degree of functionality, and thus occupies little space. The switch is thus suitable for confined physical spaces, in particular such as those on a steering wheel or else in the dashboard, in the center console, in the armrest or the like in a motor vehicle. Furthermore, the switch is not susceptible to defects and has a long life because there is no wear. The switch according to the invention can thus advantageously be used in severe environmental conditions, for example in motor vehicles. Furthermore, the switch has a good and variable tactile sense, which can be presented both actively and passively. In addition, because of the advantageous principle of operation, the switch has small moving masses and its tactile sense and operating force can be influenced and controlled by simple control techniques. Despite a high degree of functionality, the switch is simple to operate, with incorrect actions being largely precluded. Furthermore, the switch can be produced at low cost.

The use of a permanent magnet with an adhesion electromagnet and transmission in the bearing point to produce a tactile sense also has the further following advantages:

- no wear,
- variable,
- good positive guidance (guidance on 2 planes),
- minimizing of the number of components (only one magnet for a quadruple tactile sense),
- no energy consumption (advantageous in the "standby" mode),
- no noise is produced,
- production of a variable tactile sense in the sliding movement,
- the mass of the motor is decoupled from the sliding movement, and
- active tactile feedback (a mechanical impulse can be introduced into the operating element on reaching a specific menu item; the user is thus provided with tactile confirmation).

The production of the variable tactile sense in the rotary movement by an external rotor motor with a hollow shaft also has the further following advantages:

- torques can be varied by varying the current to the motor,
- high moment of inertia thus minimizing oscillations in the rest position,
- further functional elements can be fitted in the hollow shaft,
- high torque,
- no wear,
- active tactile feedback (a mechanical impulse can be introduced into the operating element on reaching a specific menu item; the user is thus provided with tactile confirmation),
- higher torques possible for the same energy, and
- reduction in the number of components, because the magnetic field can be used to resolve the angular position and for commutation.

BRIEF DESCRIPTION OF THE DRAWINGS

One exemplary embodiment of the invention will be described in more detail in the following text and is illustrated in the drawings, in which.

DETAILED DESCRIPTION OF THE INVENTION

Figure 1:
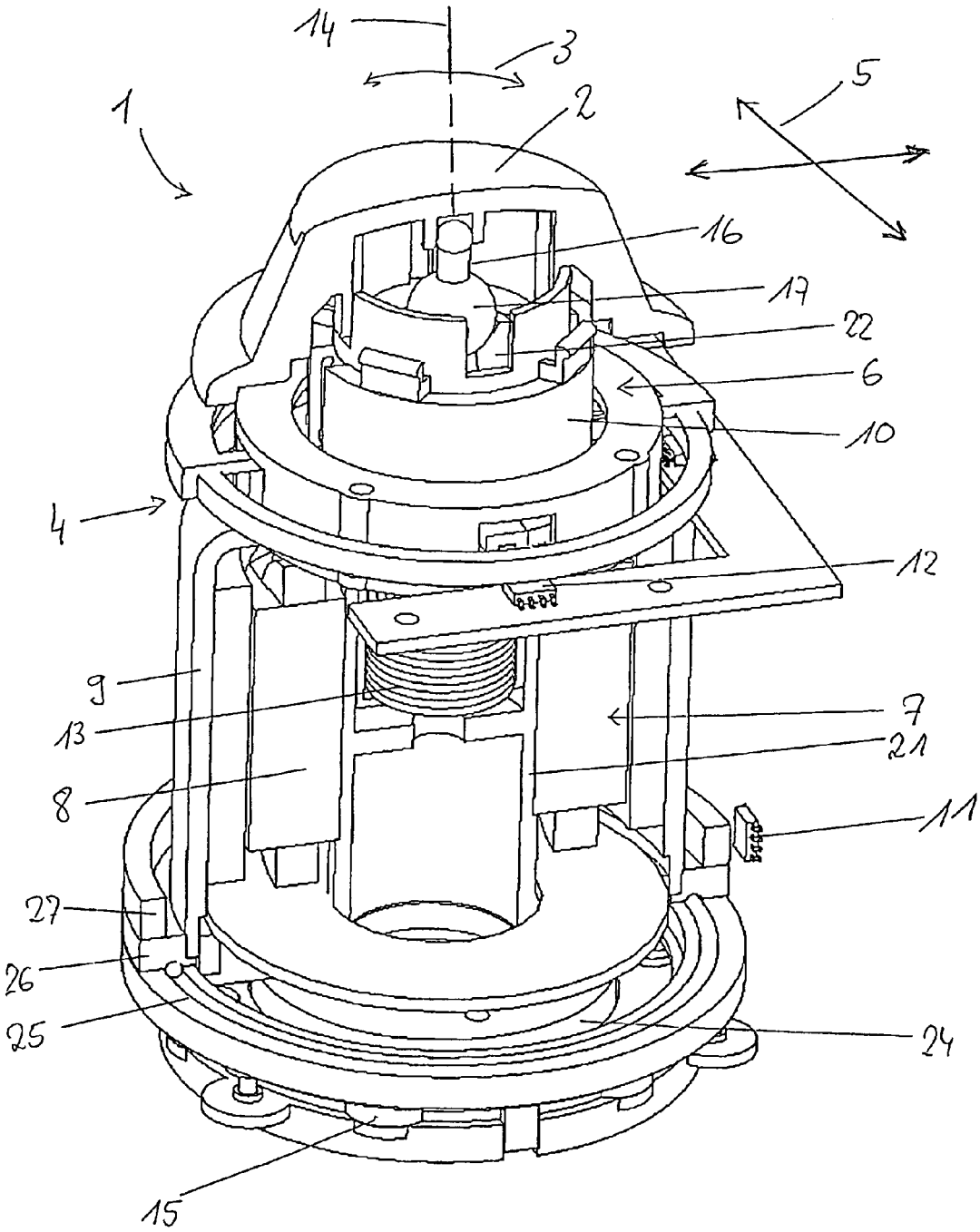
FIG. 1 shows a partially cut-open perspective view of an electrical switch according to the present invention.

FIG. 1 shows an electrical switch 1 which is in the form of a joystick or cursor switch. The switch 1 has an operating element 2 which can be rotated by a user manually in two opposite rotation directions 3. For this purpose, the operating element 2 interacts with rotation means 4. The operating element 2 has a switching effect on a switching element 11 during rotation. A controllable external rotor electric motor 7 is operatively connected to the operating element 2 in such a way that a tactile sense is produced for the rotary movement of the operating element 2. The tactile sense can be varied depending on the drive level of the external rotor motor 7. By way of example, the rotation of the operating element 2 may be made harder or easier, may be in the form of latching steps, or the like, depending on the situation.

The external rotor motor 7 has an inner stationary stator 8 as well as an outer rotating external rotor 9. The stator 8 of the external rotor motor 7 is arranged on a stationary, internal hollow shaft 21, as can be seen in more detail in FIG. 3. At least a part of the rotation means 4 comprises the external rotor 9 of the external rotor motor 7. The rest of the rotation means 4 comprises a cross carriage 10, which will be explained in more detail further below. The operating element 2 is latched to the cross carriage 10. The cross carriage 10 is itself arranged at the base of the pot-like external rotor 9, so that the rotary movement of the operating element 2 is transmitted to the external rotor 9.

Figure 2:
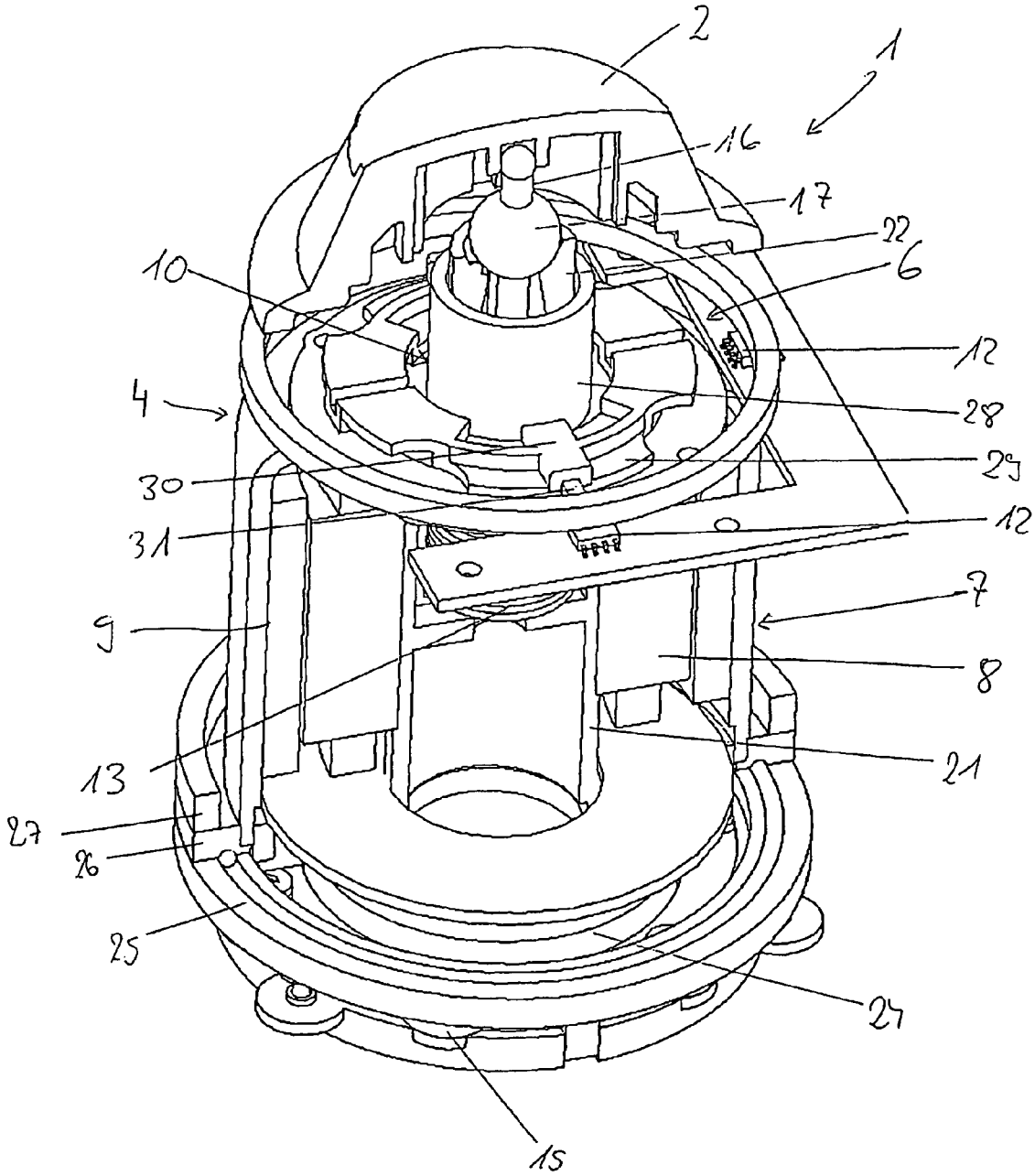
FIG. 2 shows the switch as shown in FIG. 1, but with individual parts being omitted.

As can also be seen from FIG. 1, the operating element 2 can be moved manually by the user in at least one movement direction 5 on a movement plane. In the present example, the operating element 2 can be moved in four movement directions 5, in the form of a compass rose. For this purpose, the operating element 2 interacts with movement means 6, which can be seen in FIG. 2. The operating element 2 has a switching effect on a switching element 12 during movement. A magnet 13 is operatively connected to the operating element 2 in such a way that a tactile sense is produced for the linear movement of the operating element 2.

Figure 4:
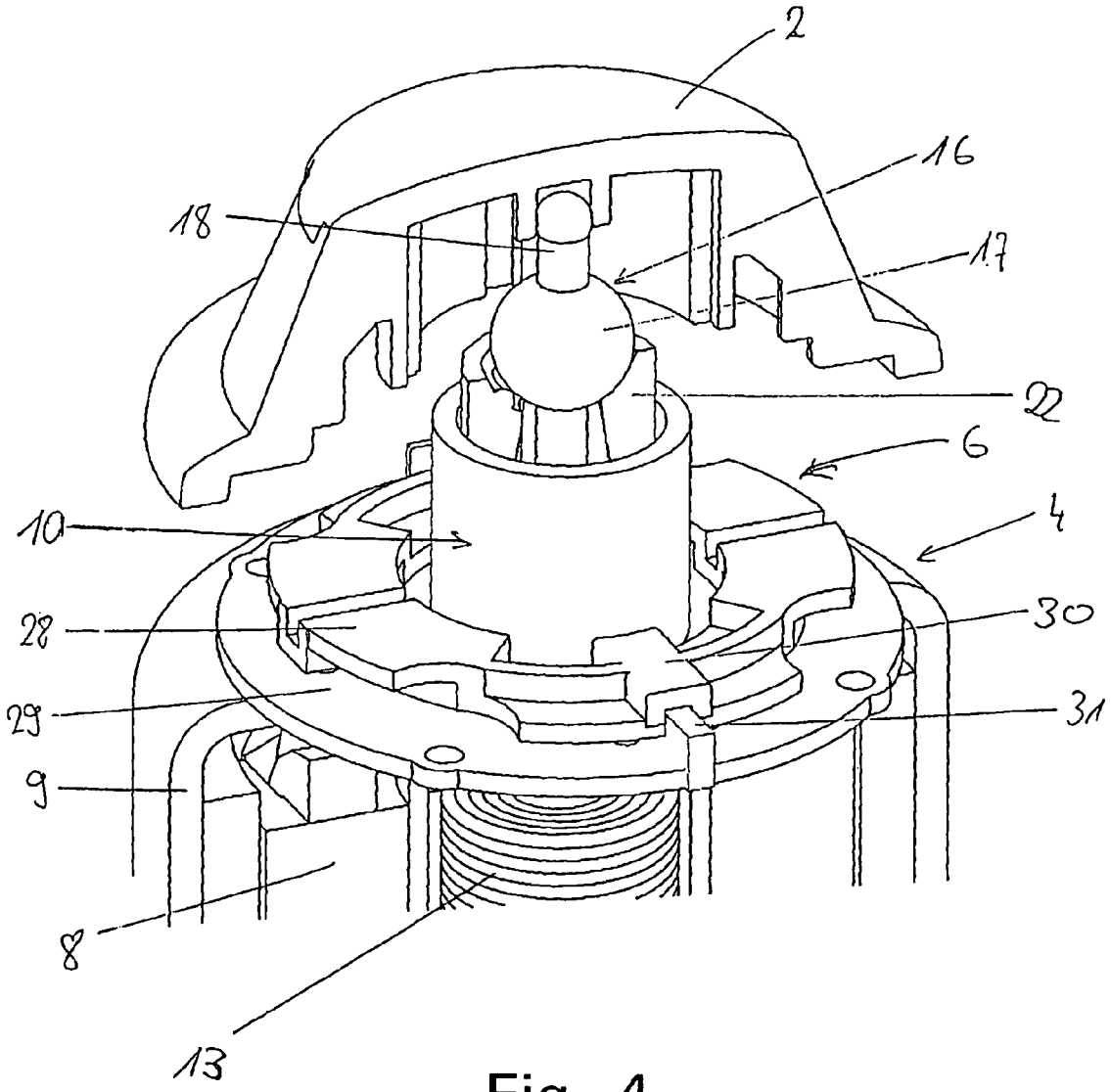
FIG. 4 shows an enlarged view in the area of the operating element shown in FIG. 3.

As can be seen in more detail in FIG. 4, the movement means 6 is in the form of a cross carriage 10. The cross carriage 10 itself comprises a first carriage part 28, to which the operating element 2 is clipped, as well as a second carriage part 29. The first carriage part 28 is arranged on studs 31 on the second carriage part 29 such that it can be moved by means of guides 30 in one of the movement directions 5. The second carriage part 29 is itself arranged at the base of the external rotor 9 such that it can be moved in the other movement directions, by means of guides and studs which are not shown in any more detail. This allows the two carriage parts 28, 29 to be moved in two mutually perpendicular movement directions 5 and in opposite directions, that is to say essentially in a cruciform form, like a compass rose.

It is particularly preferable for the operating element 2 to have the capability to be not only rotated but also moved linearly. For this purpose, the operating element 2 interacts with the rotation means 4 and with the movement means 6, as can also be seen in FIG. 1. In this case, the rotation axis 14 of the rotation means 4 is approximately at right angles to the movement plane of the movement means 6 indicated by the arrows 5. As already explained, the linear movement and the rotary movement are transmitted by means of a cross carriage 10 from the operating element 2 to the movement and rotation means 6, 4. The cross carriage 10 thus decouples the linear movement from the rotary movement.

In addition, the operating element 2 can be moved linearly from a null position to a switch position by pressing it through at least one distance. This linear movement is used as an "Enter" operation and takes place on a movement plane which is approximately at right angles to that indicated by the arrows 5, that is to say approximately parallel to the rotation axis 14. In this case, the operating element 2 has a switching effect on the switching element 15 in the switch position. The switching element 15 may be in the form of a switching mat.

Figure 5:
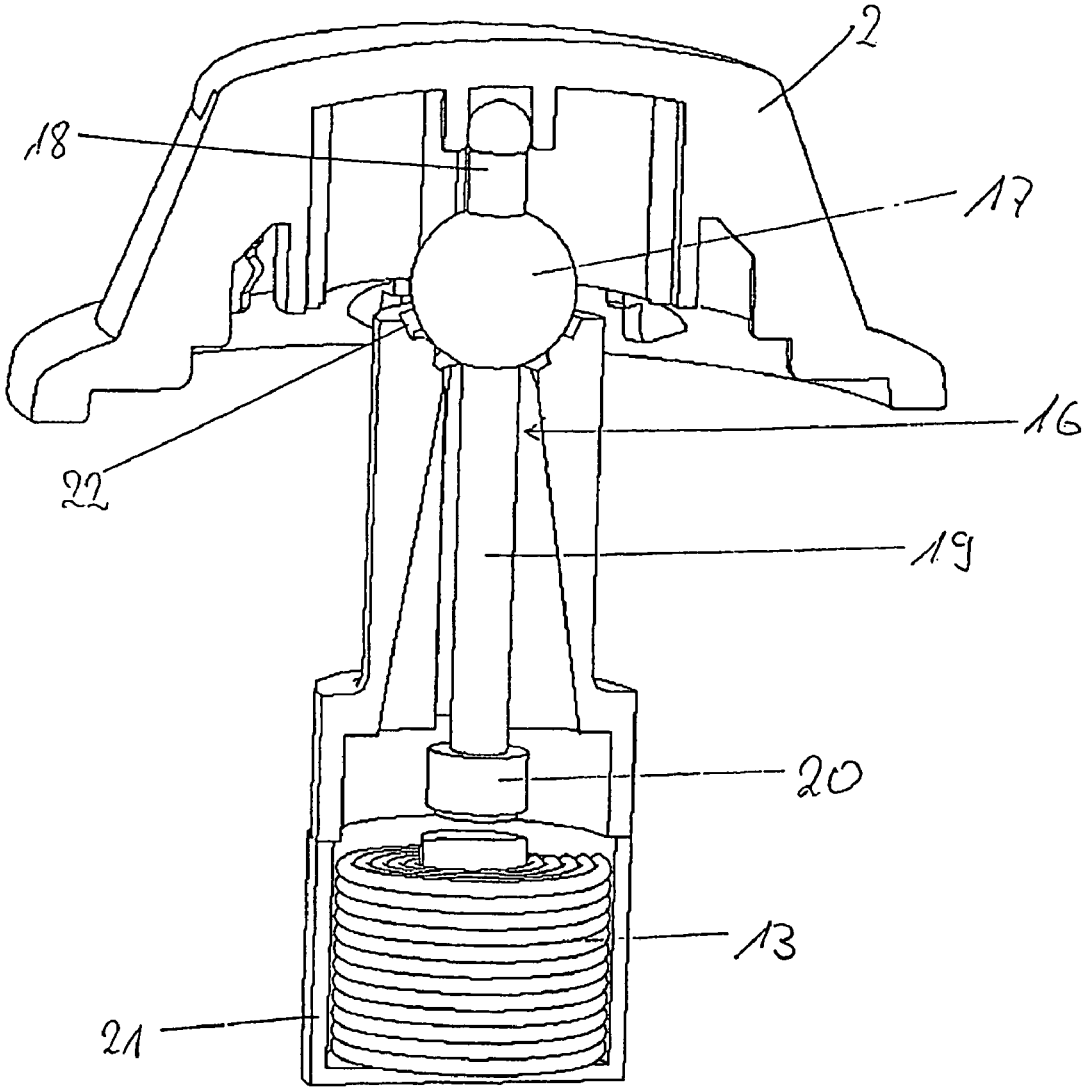
FIG. 5 shows a longitudinal section through the area of the operating element shown in FIG. 4.

As can be seen in FIG. 5, the operative connection between the magnet 13 and the operating element 2 is produced by means of a ball lever 16. The ball lever 16 has a ball 17 in the form of a ball joint as a pivoting bearing. The ball holding 22 for the ball joint of the ball lever 16 is arranged on the internal hollow shaft 21 in the external rotor motor 7. The ball lever 16 has two lever arms 18, 19, which originate from the ball 17. The operating element 2 is attached to one lever arm 18. The other lever arm 19 is in the form of a free end, with a permanent magnet 20, which interacts with the magnet 13, being attached to the free end. The length ratio of the two lever arms 18, 19 is chosen so as to increase the force for the linear movement of the operating element 2. The magnet 13 is located in the internal hollow shaft 21 in the external rotor motor 7 and is in the form of a controllable adhesion electro-magnet, so that the tactile sense for the linear movement of the operating element 2 can be varied as appropriate for the situation on the basis of the electrical drive to the adhesion electromagnet 13.

Figure 3:
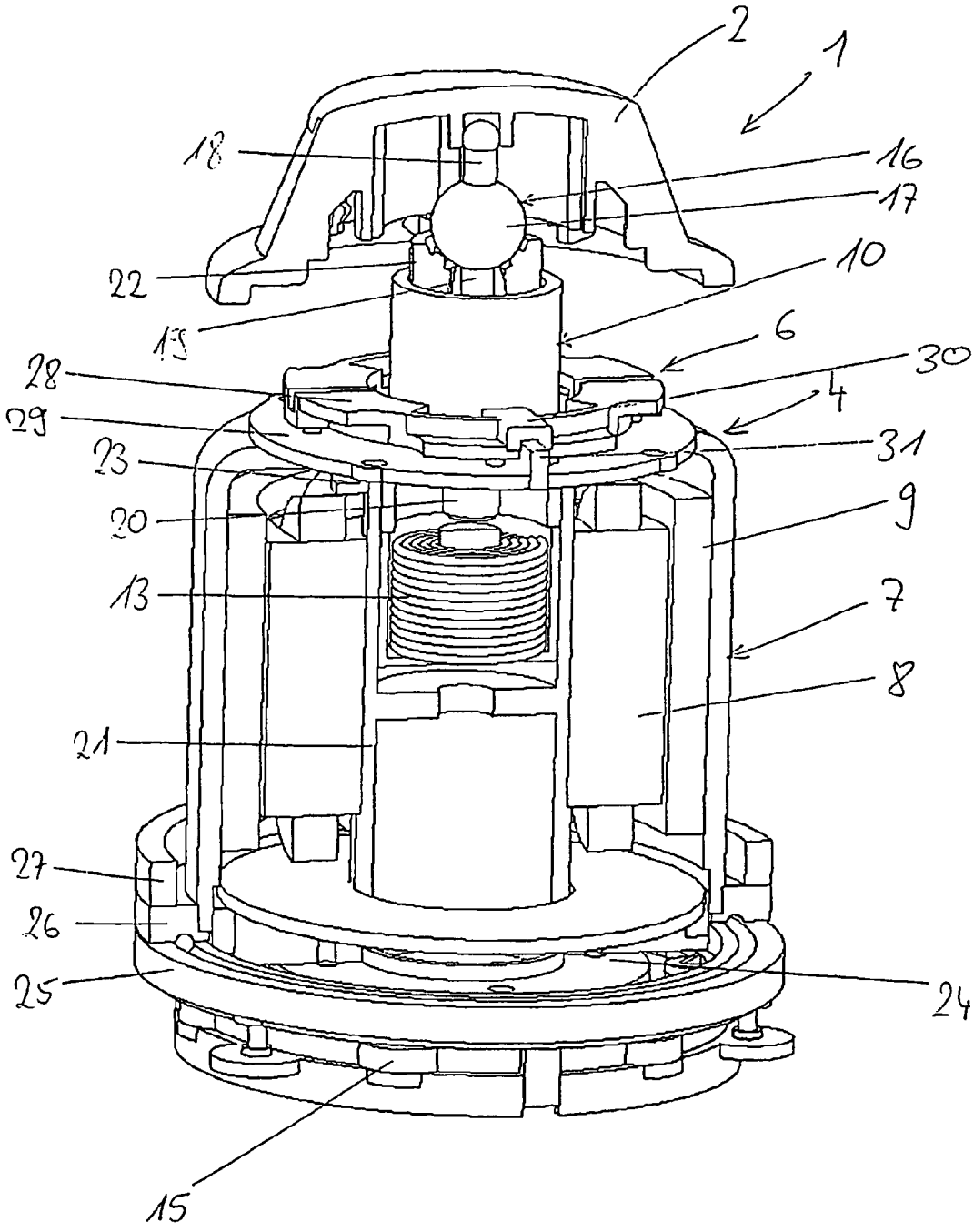
FIG. 3 shows the switch as shown in FIG. 2, but with further individual parts being omitted.
Figure 6:
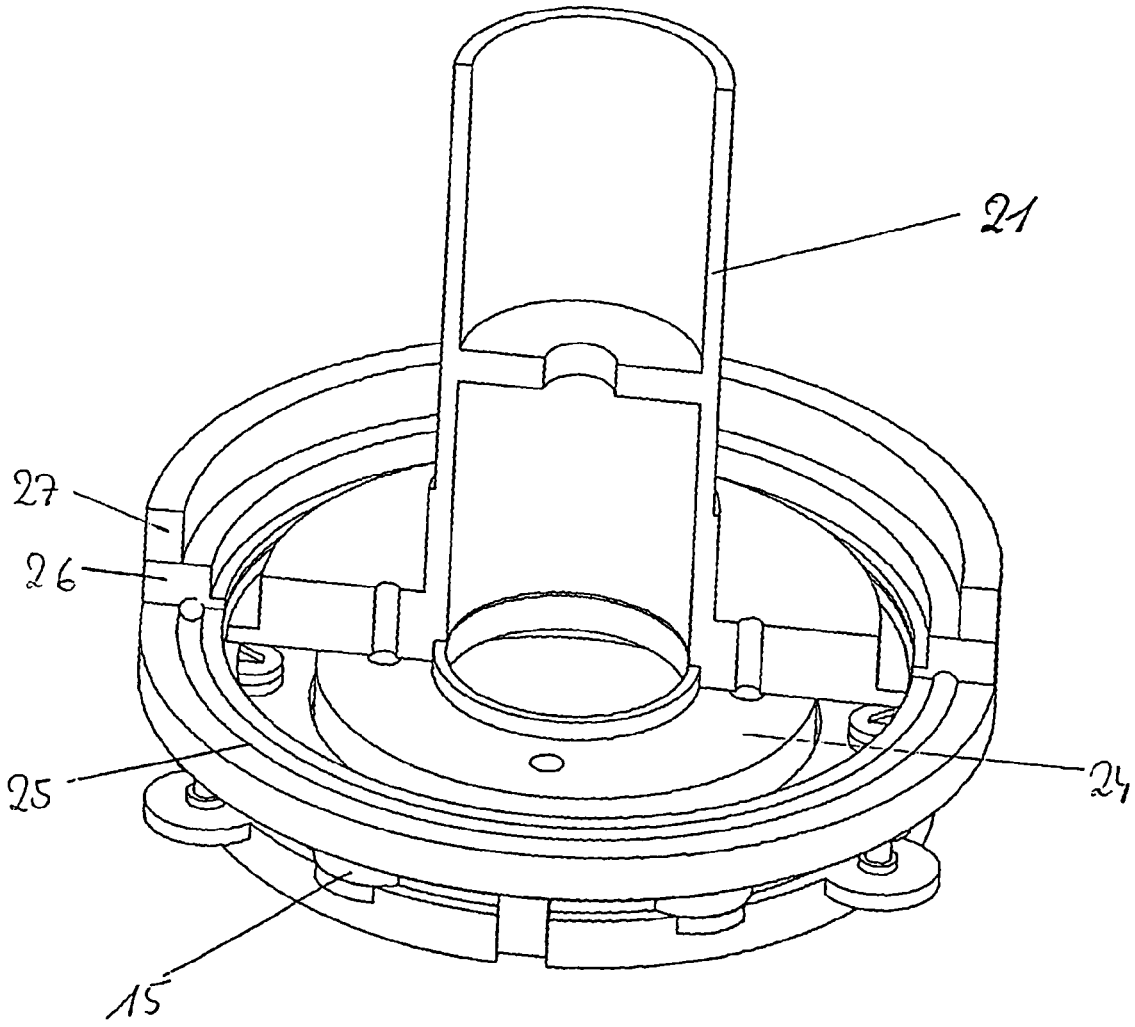
FIG. 6 shows an enlarged view of the area facing away from the operating element in FIG. 3.
Figure 7:
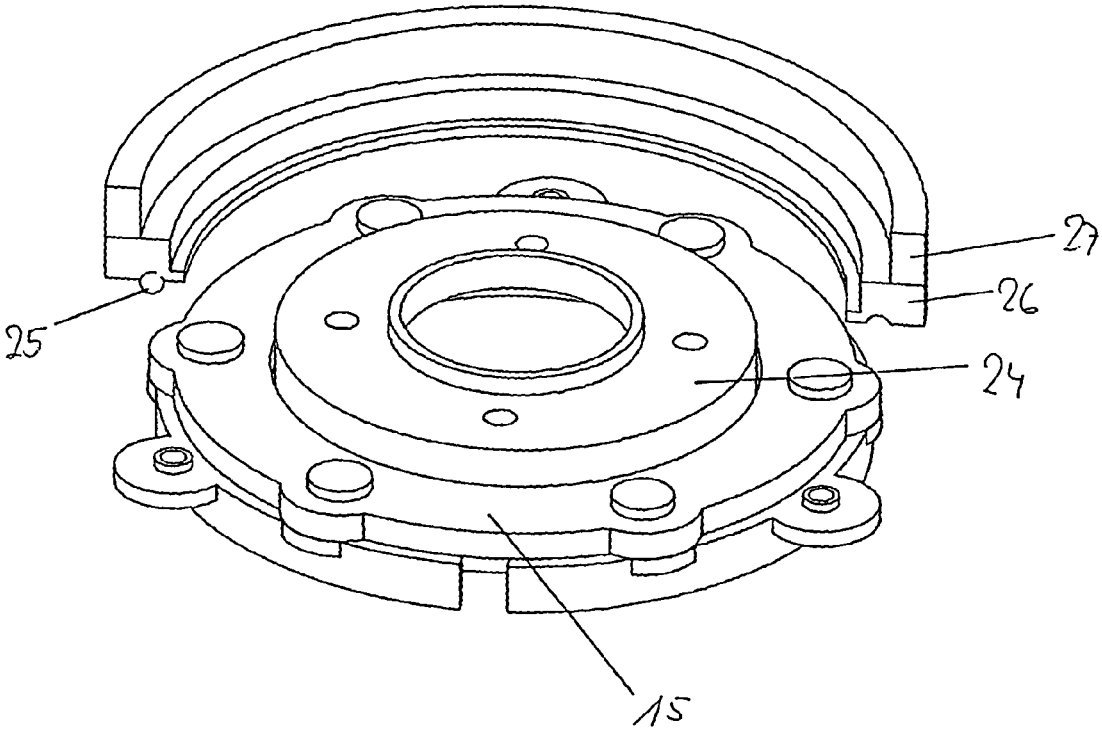
FIG. 7 shows the area from FIG. 6, but with individual parts being omitted.

At its base, the external rotor 9 is mounted such that it can rotate by means of a journal bearing 23, which is shown in FIG. 3, on the hollow shaft 21. As can also be seen in FIG. 6, a supporting part 24, which is attached to the hollow shaft 21, is located on the side of the external rotor 9 facing away from the base. A ball raceway 25 is located on the supporting part 24, on which, in turn, a ring 26 is mounted such that it can rotate, with the ring 26 being attached to that side of the external rotor 9 which faces away from the base. Because the rotation speed at which the external rotor motor 7 is operated in the switch 1 is only low, a bearing such as this by means of a journal bearing 23 and/or a ball raceway 25 is completely adequate. The supporting part 24 with the lower face of the ball raceway 25 then has a switching effect on the switching mat 15 when the operating element 2 is pushed, as can be seen from FIG. 7.

The switching elements 11, 12 which detect the rotation and/or the linear movement are Hall sensors. As is evident in more detail from FIG. 1, an alternately magnetized rim 27 is fitted on the ring 26. When the external rotor 9 is being rotated by the operating element 2, this rim 27 interacts with the Hall sensor 11 as appropriate for signal production. In the same way, the Hall sensor 12 can also be operated to produce signals when the operating element 2 is being used to move the first carriage part 28, which is appropriately magnetized and/or has separate magnets. The switching elements 11, 12, 15 may, of course, also be in the form of other sensors, for example magnetoresistive sensors, electrical switches, switching mats or the like.

The following features and advantages will now be described in particular, with reference to the described design of the switch 1.

The operation and tactile sense for the rotary movement are produced by an external rotor motor 7 having a hollow shaft 21. When the operating element 2 is rotated, then the external rotor motor 7 produces an opposing torque. The torque is transmitted through a cross carriage 10. The opposing torque becomes greater or less depending on the rotation angle. This is perceived as a latching action on the operating element 2. The arrangement with an external rotor motor 7 with a hollow shaft 21 has the following advantages:

- high arrangement moment inertia, thus minimizing oscillation in the rest position,
- further functional elements can be fitted in the hollow shaft 21, and
- high torque can be produced with the aid of the arrangement.

The function of the linear movement is provided with an active tactile sense, in the form of a two-level switch. The operation is initiated by linear movement of the operating element 2. The operating element 2 ensures operation at two levels. The operating element 2 is mounted on a cross carriage 10 in order to allow a linear movement. This arrangement allows a sliding movement without movement of the external rotor motor 7. The mass of the external rotor motor 7 is thus decoupled from the linear movement, which in itself results in advantages.

The operating element 2 deflects the ball lever 16. The ball lever 16 is mounted in a convex half shell in order to allow a pivoting movement. The opposing bearing is formed by the ball holder 22. A magnet 20 is incorporated in the ball lever 16. The adhesion electro-magnet 13 forms the opposing pole. The magnet 20 centers the ball lever 16 and guarantees that the operating element 2 will return to its position after operation on one of the two levels. In order to allow the operating element 2 to be deflected, it is necessary to overcome the force of the magnet 20. The size of the gap and the relative position of the ball lever 16 lead, as a result of the change, to a change in the magnetic flux. This means that the force is minimized when the ball lever 16 is outside the magnetic field. A tactile sense is thus produced for the linear movement.

The design of the ball lever 16 allows a relatively short operating movement to be provided on the operating element 2. The ball lever 16 provides a step-up ratio, so that a short operating movement is stepped up to a large pivoting movement. The tactile sense can be varied by varying the current through the adhesion electromagnet 13 as a function of the position of the cross carriage 10. Different tactile profiles can thus be mapped, and the force can also be varied. In addition, if desired, the operating element 2 may be locked in an end position.

The Enter function can be initiated by pushing the operating element 2. The associated tactile sense is produced in a simple manner by means of the switching mat 15.

Although it is preferable to be able to operate the switch 1 both by rotation and by linear movement, the invention can also be implemented, as described, on a switch which can be operated either by rotation or by linear movement. In addition, an Enter function can also be implemented by pushing. In general, the invention is not restricted to the described and illustrated exemplary embodiment. In fact, it also covers all specialist developments within the scope of the invention as defined by the patent claims. A multifunction switch such as this can thus be used not only in motor vehicle applications but also as input means for computers, machine tools, domestic appliances or the like.

LIST OF REFERENCE SYMBOLS

1: Electrical switch
2: Operating element
3: Rotation direction
4: Rotation means
5: Movement direction/arrow
6: Movement means
7: External rotor motor
8: Stator
9: External rotor
10: Cross carriage
11: Switching element (for rotary movement)/Hall sensor
12: Switching element (for linear movement)/Hall sensor
13: Magnet/adhesion electromagnet
14: Rotation axis
15: Switching element (for pushing)/switching mat
16: Ball lever
17: Ball (on the ball lever)
18, 19: Lever arm (of the ball lever)
20: Permanent magnet
21: Hollow shaft
22: Ball holder
23: Journal bearing
24: Supporting part
25: Ball raceway
26: Ring
27: Rim
28: First carriage part (of the cross carriage)
29: Second carriage part (of the cross carriage)
30: Guide (on the first carriage part)
31: Stud (on the second carriage part)

What is claimed is:

1. An electrical switch having a form of one of a joystick and a cursor switch, the electrical switch comprising:

an operating element that interacts with rotation means such that the operating element can be rotated, the operating element having a switching effect on a switching element during rotation; and a controllable external rotor electric motor operatively connected to the operating element such that a variable tactile sense is produced for the rotation of the operating element, the external rotor electric motor comprising an inner stationary stator and an outer rotating external rotor;

wherein at least a part of the rotation means comprises the external rotor of the external rotor electric motor, so that the rotary movement of the operating element is transmitted the external rotor.

2. The electrical switch of claim 1, wherein the operating element also interacts with movement means such that the operating element can be moved in at least one linear direction on a movement plane, the operating element also having a switching effect on a second switching element during the linear movement; and a magnet operatively connected to the operating element such that a tactile sense is produced for the linear movement of the operating element.

3. The electrical switch of claim 2, wherein the operating element can be moved linearly by pushing at approximately right angles to the movement plane through at least one path from a null position to a switching position such that the operating element has a switching effect on a third switching element in the switching position.

4. The electrical switch of claim 2, wherein the operative connection between the magnet and the operating element is produced by means of a ball lever.

5. The electrical switch of claim 4, wherein a ball holder for the ball joint of the ball lever is arranged on an internal hollow shaft in the external rotor electric motor, and wherein the magnet is preferably located in the internal hollow shaft in the external rotor electric motor.

6. The electrical switch of claim 4, wherein the ball lever includes a ball in the form of a spherical joint as a pivoting bearing.

7. The electrical switch of claim 6, wherein a length ratio of two lever arms which originate from the ball provides an increase in force.

8. The electrical switch of claim 7, wherein the ball lever has an end which is attached to the operating element on one lever arm and has a free end on the other lever arm.

9. The electrical switch of claim 8, wherein a permanent magnet is attached to the free end of the ball lever and wherein the permanent magnet interacts with the magnet.

10. The electrical switch of claim 9, wherein the magnet has a form of a controllable adhesion electromagnet in order to vary the tactile sense.

11. The electrical switch of claim 2, wherein the switching elements are selected from the group consisting of a Hall sensor, a magnetoresistive sensor, an electrical switch, and a switching mat.

12. The electrical switch of claim 1, wherein the operating element also interacts with movement means such that the operating element can be moved in at least one linear direction on a movement plane;

wherein the operating element also has a switching effect on a second switching element during the linear movement; and wherein the linear movement and the rotation are transmitted to the movement means and rotation means from the operating element by means of a cross carriage.

13. The electrical switch of claim 12, wherein the operating element can be moved linearly by pushing at approximately right angles to the movement plane through at least one path from a null position to a switching position such that the operating element has a switching effect on a third switching element in the switching position.

14. The electrical switch of claim 12, wherein the switching elements are selected from the group consisting of Hall sensors, magnetoresistive sensors, electrical switches, and switching mats.

15. The electrical switch of claim 12, wherein a rotation axis of the rotation means is approximately at right angles to the movement plane of the movement means.

16. The electrical switch of claim 1, wherein the operating element can be moved linearly by pushing, at approximately right angles to a movement plane, through at least one path from a null position to a switching position, such that the operating element has a switching effect on the switching element in the switching position.

17. The electrical switch of claim 1, wherein the switching element is selected from the group consisting of a Hall sensor, a magnetoresistive sensor, an electrical switch, and a switching mat.

18. The electrical switch of claim 1, wherein the stator of the external rotor electric motor is arranged on a stationary, internal hollow shaft, and wherein the external rotor is mounted such that it can rotate by means of at least one of journal bearings on the hollow shaft and by means of a ball raceway on a supporting part which is attached to the hollow shaft, of the external rotor electric motor.

19. An electrical switch having a form of one of a joystick and a cursor switch, the electrical switch comprising:

an operating element that interacts with rotation means such that the operating element can be rotated, and that also interacts with movement means such that the operating element can be moved in at least one linear direction on a movement plane, the operating element having a switching effect on a first switching element during the rotation and also having a switching effect on a second switching element during the linear movement; and a controllable external rotor electric motor operatively connected to the operating element such that a variable tactile sense is produced for the rotation of the operating element;

wherein at least part of the rotation means comprises an external rotor of the external rotor electric motor; and wherein the linear movement and the rotation are transmitted to the movement means and rotation means from the operating element by means of a cross carriage.

* * * * *